US006516732B1

(12) United States Patent
LaCombe et al.

(10) Patent No.: US 6,516,732 B1
(45) Date of Patent: Feb. 11, 2003

(54) STORAGE SHELVING MODULE

(76) Inventors: John A. LaCombe, 11768 Avenida Del Sol, Northridge, CA (US) 91326; Christopher M. Clifford, 22525 Gilmore St., West Hills, CA (US) 91307

( * ) Notice: Subject to any disclaimer, the term of this patent is extended or adjusted under 35 U.S.C. 154(b) by 0 days.

(21) Appl. No.: 09/785,075

(22) Filed: Feb. 16, 2001

Related U.S. Application Data

(60) Provisional application No. 60/183,473, filed on Feb. 18, 2000.

(51) Int. Cl.[7] ..... A47B 47/00
(52) U.S. Cl. ..... 108/180; 108/153.1
(58) Field of Search ..... 108/59, 64, 102, 108/91, 180, 143, 137; 312/153.1, 205, 265.1, 265.4

(56) References Cited

U.S. PATENT DOCUMENTS

| | | | | |
|---|---|---|---|---|
| 2,739,776 | A | * | 3/1956 | Terando |
| 2,873,934 | A | * | 2/1959 | Settles |
| 2,909,350 | A | * | 10/1959 | Morris |
| 3,346,316 | A | | 10/1967 | Morioka et al. |
| 3,760,744 | A | * | 9/1973 | Cruckshank |
| 3,835,354 | A | | 9/1974 | Torres-Pena |
| 3,916,802 | A | * | 11/1975 | Virtue et al. |
| 4,286,525 | A | * | 9/1981 | Willmore |
| 4,418,627 | A | | 12/1983 | Baker |
| 4,426,120 | A | | 1/1984 | Johnson et al. |
| 4,433,881 | A | | 2/1984 | Witten et al. |
| 4,477,128 | A | | 10/1984 | Hasbrouck |
| 4,500,146 | A | * | 2/1985 | Peterson |
| 4,681,378 | A | | 7/1987 | Hellman, III |
| 4,717,214 | A | | 1/1988 | Moore et al. |
| 4,859,008 | A | | 8/1989 | Eyre et al. |
| 5,525,000 | A | | 6/1996 | Belobraydich et al. |
| 5,570,968 | A | | 11/1996 | Sassmannshausen et al. |

FOREIGN PATENT DOCUMENTS

| | | | |
|---|---|---|---|
| IT | 640975 | * | 6/1962 |

* cited by examiner

*Primary Examiner*—Jose V. Chen
(74) *Attorney, Agent, or Firm*—Dolland & Knight LLP

(57) ABSTRACT

A storage shelving module preferably expandable in three dimensions so as to vary the size and capacity of the module without the need to supplement or replace component parts. The module includes first and second frame sub-assemblies, each of which includes four telescoping elements. Each telescoping element defines horizontally and vertically extending leg members. Each of the horizontally extending legs defined by a telescoping element in each of the two sub-assemblies is disposed in a telescopic relationship with another horizontally extending leg in the same sub-assembly and the vertically extending legs in the first sub-assembly are disposed in telescopic relationship with the vertically extending legs in the second sub-assembly. Locking mechanisms are provided for securing each pair of legs disposed in a telescopic relationship together in a fixed disposition at selective locations whereby the collective length of each such pair of legs is adjustable to vary the size and capacity of the shelving module.

21 Claims, 17 Drawing Sheets

STORAGE SHELVING MODULE

This application claims the benefit of U.S. Provisional Patent Application Ser. No. 60/183,473, filed Feb. 18, 2000.

BACKGROUND OF THE INVENTION

The present invention relates to shelving for the storage or display of goods, items, boxes or the like, and, in particular, is directed to a storage shelving module that is expandable and contractible to accommodate varying storage and display requirements.

Most conventional storage and display shelving has vertical posts or sides that are of a fixed length to which shelves of a fixed size are attached. The shelves may be movable vertically for accommodating items of different heights. Conventionally, if the storage or display shelving requires expansion in heighth, width or depth, the vertical posts or sides must be replaced or additional posts or sides added and new shelves are added or replace the existing shelves for accommodating the new size of the shelving module. It would be desirable to provide a storage shelving module which is expandable in one or more directions, and preferably in three dimensions, so that the size and capacity of the shelving could be significantly varied without the need to supplement or replace the components thereof The storage shelving module of the present invention obtains this result.

SUMMARY OF THE INVENTION

Briefly, the storage shelving module of the present invention is expandable in its preferred embodiment in all three dimensions without the need to add or replace any of the component parts. The module contains two frame sub-assemblies wherein each sub-assembly includes four telescoping elements. Each of the elements defines a pair of horizontally extending legs and a vertically extending leg. Each horizontally extending leg in one of the sub-assemblies is disposed in a telescopic relationship with another horizontally extending leg in the same sub-assembly. Each vertically extending leg defined by a telescoping element in one of the sub-assemblies is disposed in a telescopic relationship with a vertically extending leg defined by a telescoping element in the other frame sub-assembly. A leg locking mechanism is operatively connected to each pair of legs disposed in a telescopic relationship to secure each such pair of telescoping legs together in a fixed disposition at selective locations along the legs such that the collective length of each pair of legs is adjustable to vary the size and capacity of the storage shelving module.

The storage shelving module of the present invention preferably includes an expandable shelf support assembly which is comprised of four telescoping corner elements and a pair of cross members. Each of the corner elements defines a pair of horizontally extending legs and a vertically extending open ended channel. The cross members are axially aligned in a telescopic relationship and extend horizontally across the support assembly with each cross member defining a horizontally extending open ended channel adjacent its extended end. Each of the horizontally extending legs defined by one of the corner elements is disposed in a telescopic relationship with another horizontally extending leg defined by another of the corner elements. At least one of the horizontally extending legs defined by one of the corner elements extends through one of the horizontally extending channels in one of the cross members and at least one of the vertically extending legs defined by one of the telescoping members extends through one of the vertically extending channels defined by one of the corner elements such that the storage support shelf assembly is expandable in width and depth to replicate variations in such dimension in the storage shelving module.

An expandable shelf assembly is also preferably provided for use with the storage module. The shelf assembly is also expandable in width and depth and is adapted to be supported by the shelf support assembly to accommodate variations in size of the shelf support assembly. The shelf assembly is comprised of four substantially planar elements each of which defines a substantially square upper surface and has a pair of guide flanges extending downwardly and inwardly from adjacent perimeter portions of the support surface. The shelf elements are slidably disposed in a stacked configuration such that each of the flanges on the shelf elements overlap a portion of one of the flanges on another of the shelf elements such that each of the shelf elements is disposed in a telescoping relationship with the other shelf elements allowing the elements to be slided between square and rectangular configurations of varying size.

The principle object of the present invention is to provide a storage shelving module that is expandable in at least one dimension and preferably in all three dimensions, i.e. heighth, width and depth, to expand the size and capacity of the storage shelving module without the need to add or replace the component parts or the shelves. Other objects and advantages of this invention will appear from the detailed description of the preferred embodiment and the accompanying drawings.

DETAILED DESCRIPTION OF THE PREFERRED EMBODIMENT

Figure 2:
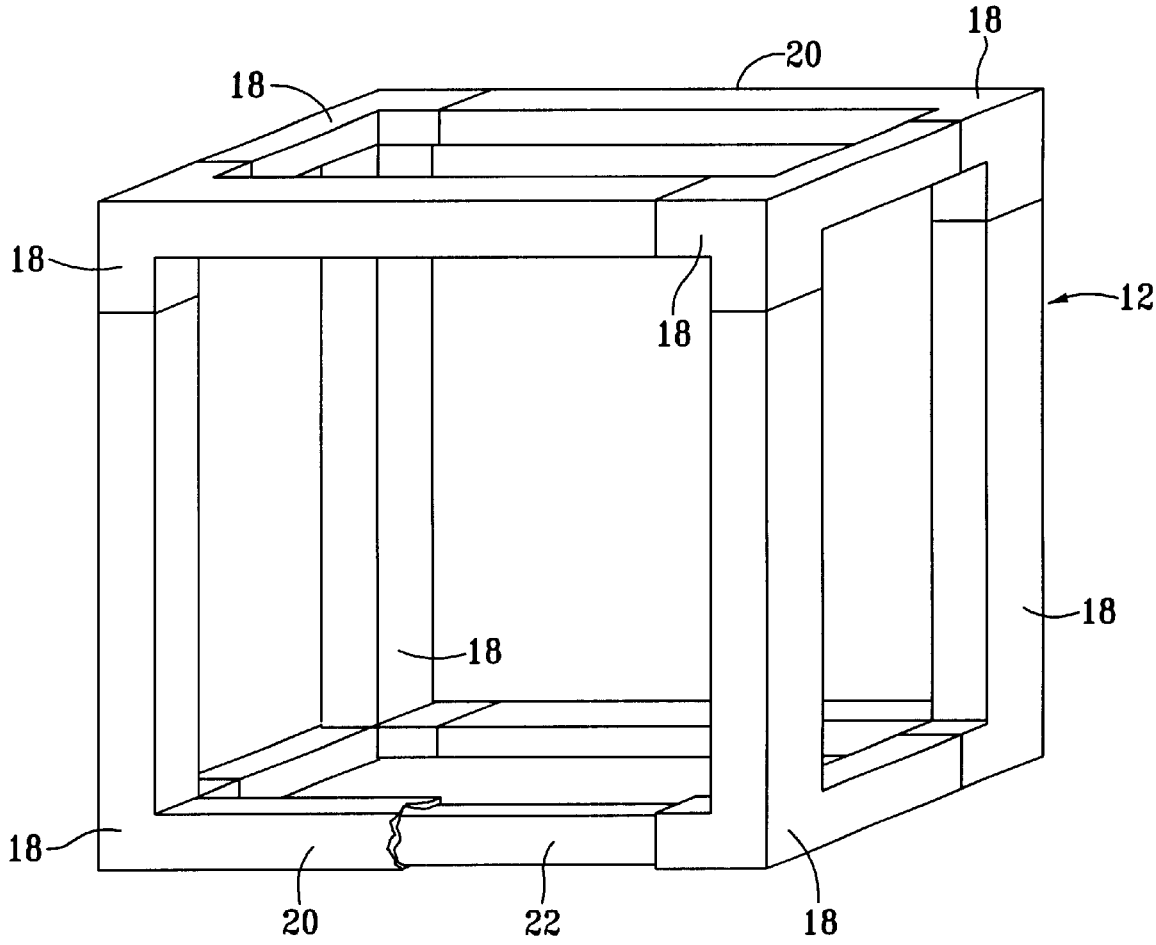
FIG. 2 is a perspective view of the frame of the storage module of FIG. 1 with a portion of a telescoping element cut away.
Figure 3:
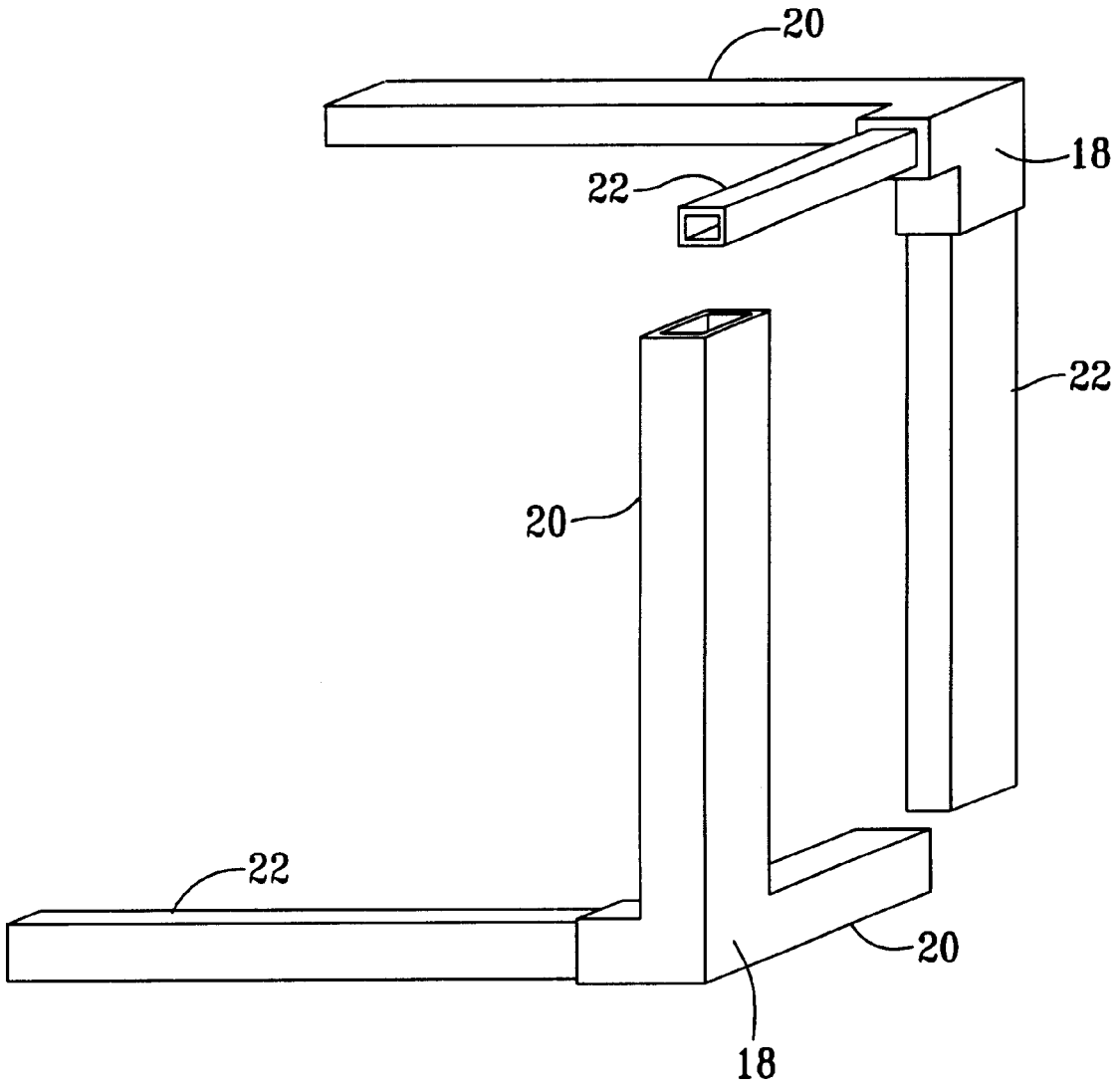
FIG. 3 is an exploded perspective view of two of the telescoping elements of the storage module frame.
Figure 18:
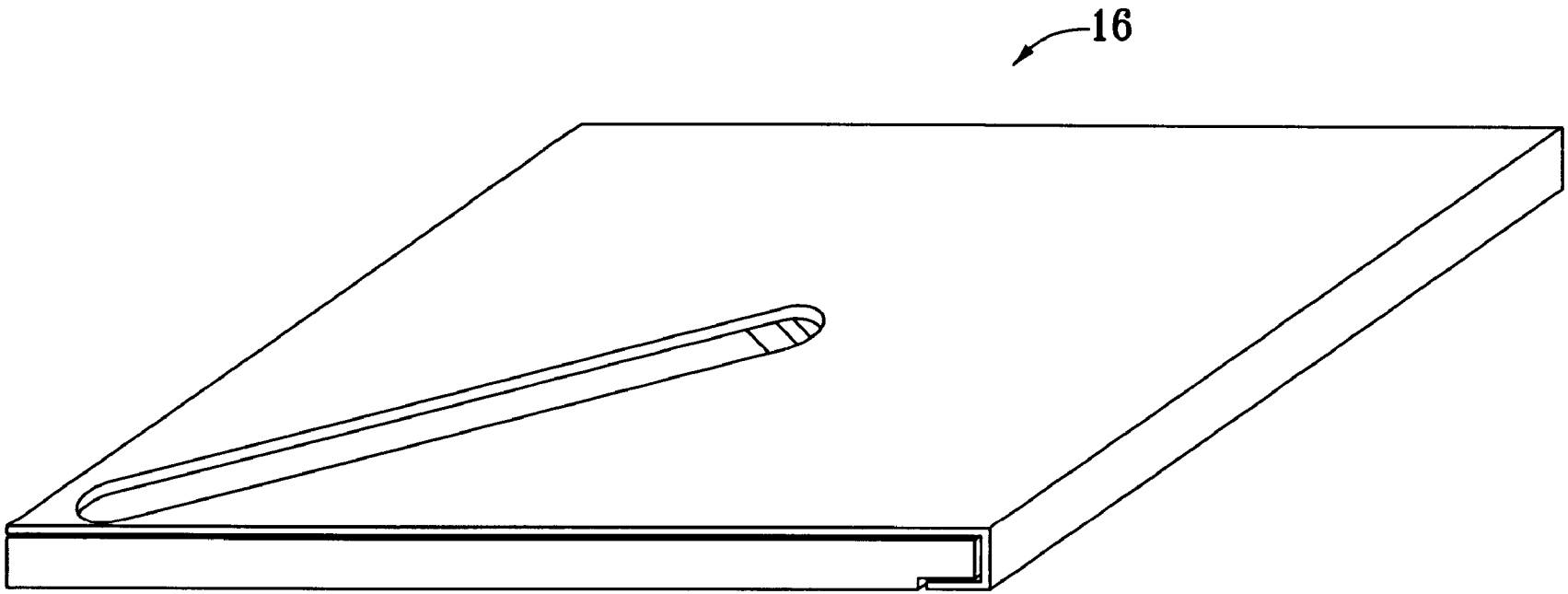
FIG. 18 is a perspective view of an assembly of four sliding shelf elements illustrated in FIG. 17 in the stacked and closed condition.
Figure 19:
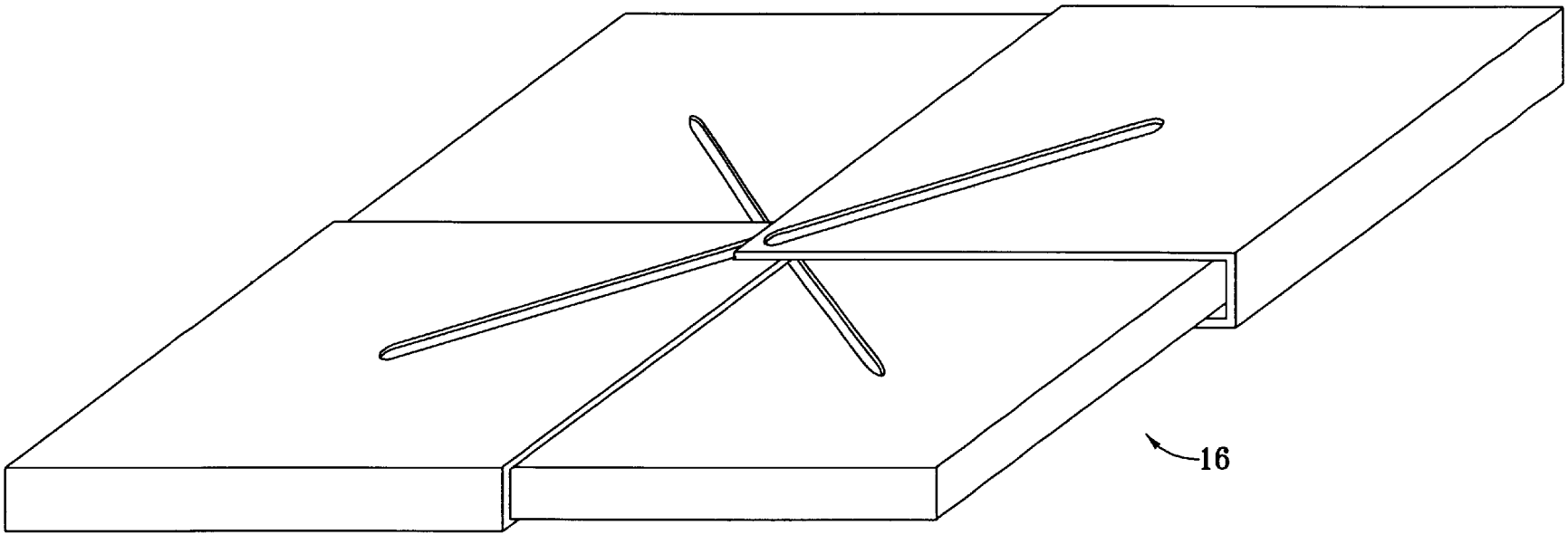
FIG. 19 is a perspective view of the sliding shelf assembly of FIG. 18 with the sliding shelf elements in the fully extended condition.

Referring now to the drawings in greater detail, the storage shelving module 10 of the present invention is comprised of a storage module frame 12, one or more shelf support assemblies 14, as needed, and one or more sliding shelf assemblies 16 (see FIGS. 18 and 19) as needed. The storage module frame 12 is comprised of eight telescoping elements 18, two of which are shown in FIG. 3, that telescopically interconnect to form a cube as shown in FIG. 2. Each telescoping element 18 has a corner from which three legs extend at mutual right angles and each leg is either an outer leg 20 or an inner leg 22 that is of a size and shape to telescopically fit and slide within an outer leg 20. For example, without limiting the scope of the invention, the outer leg 20 may be comprised of one inch square tubing having a 1/16" wall thickness and the inner leg 22 may be 7/8" square tubing that will slidably fit within the outer leg 20. For a storage module for supporting heavy loads the wall thickness of the tubing may be increased and the nominal sizes changed to still maintain the telescopic sliding feature. Further, the legs 20 and 22 may be cylindrical tubing or any other desired shape and of appropriate sizes to maintain the telescopic sliding feature.

Figure 4:
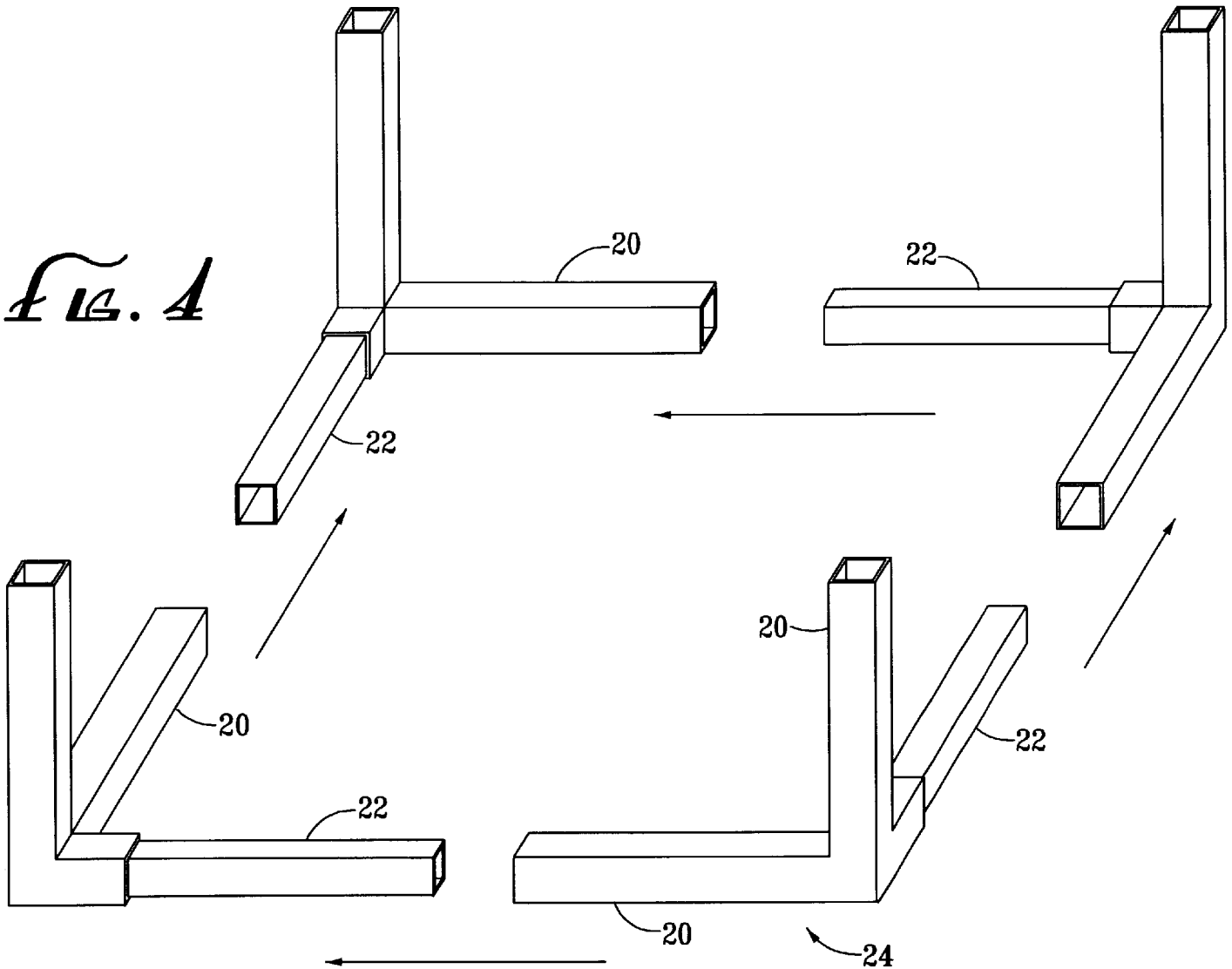
FIG. 4 is an exploded perspective view of the four telescoping elements that form the base frame sub-assembly of the storage module frame.
Figure 5:
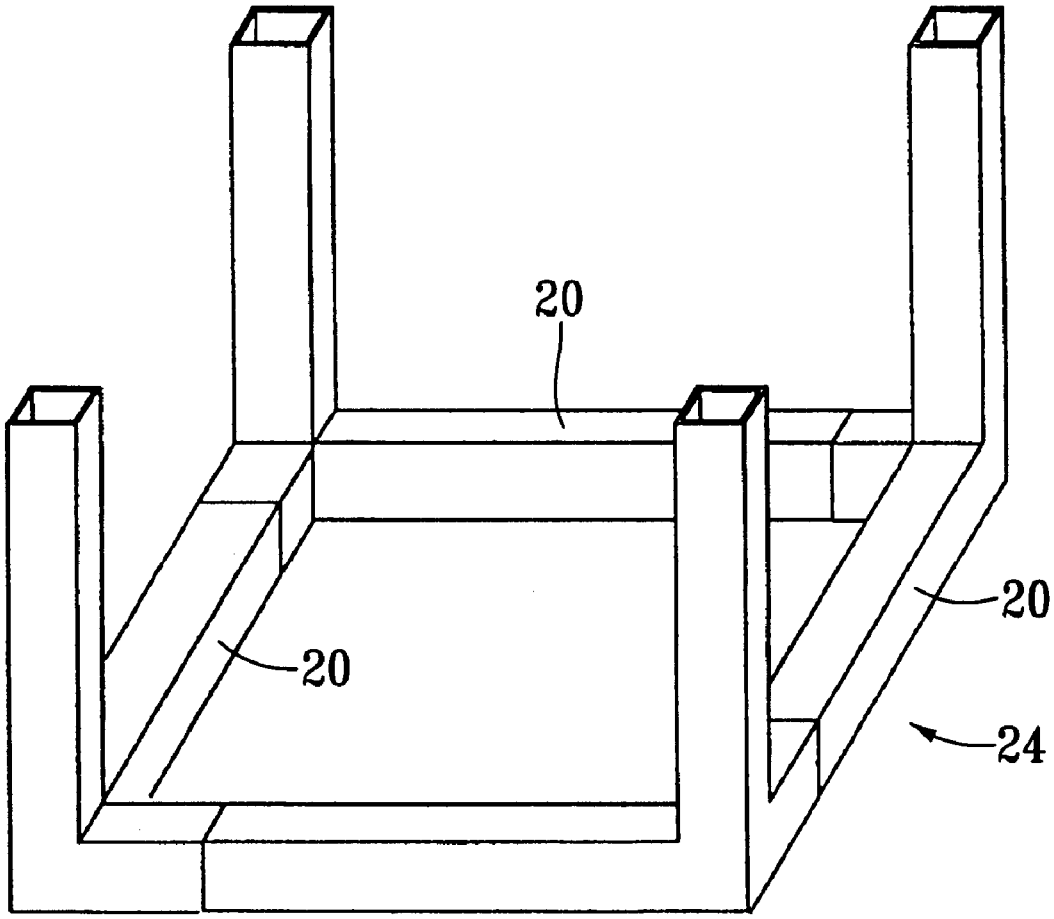
FIG. 5 is a perspective view of the base frame sub-assembly formed by the four telescoping elements shown in FIG. 4.
Figure 9:
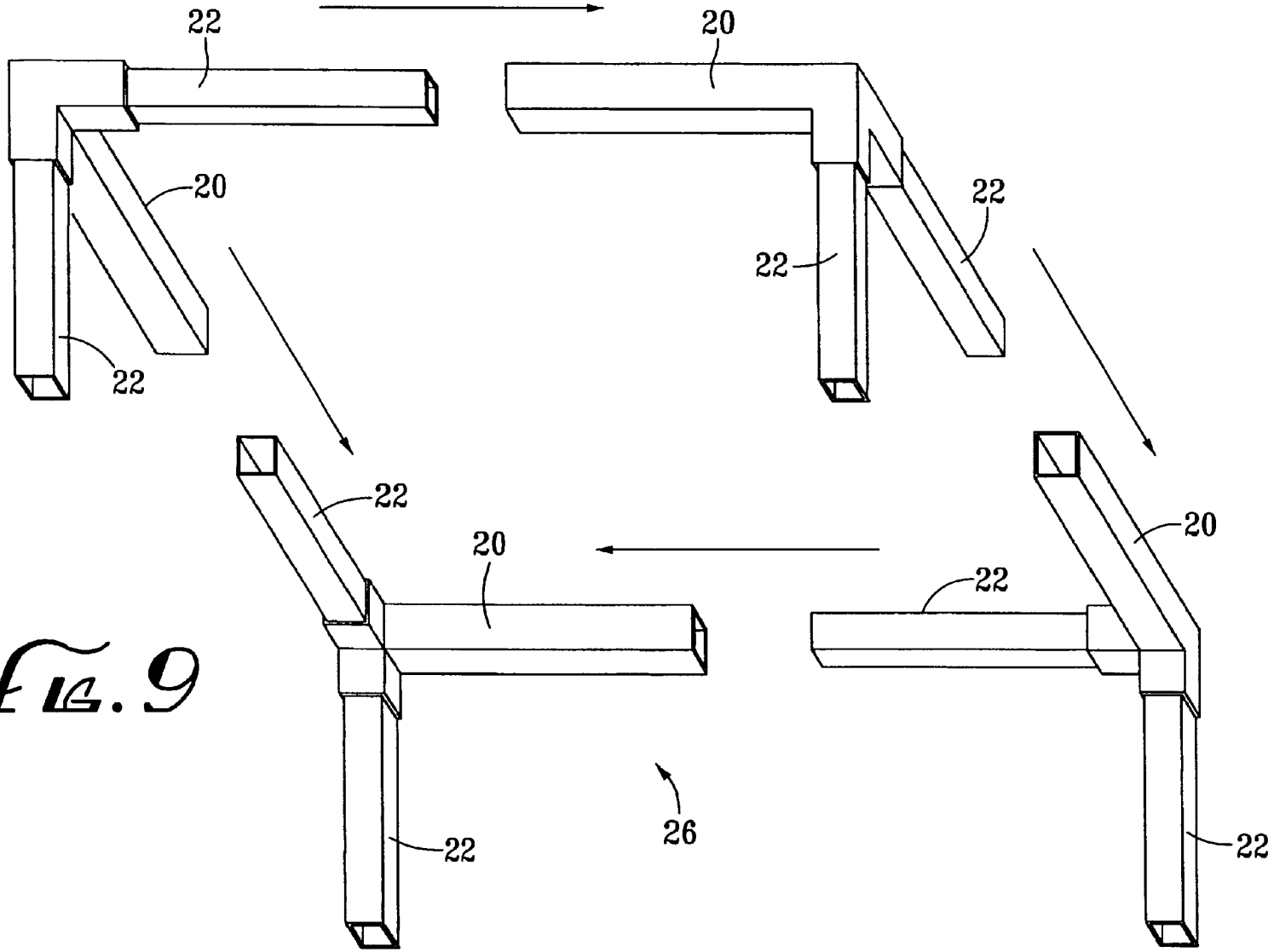
FIG. 9 is an exploded perspective view of the upper frame sub-assembly of the storage module shown in FIG. 1.

The telescoping elements 18 are preferably of only two different types of configurations to minimize the number of different components needed to construct the storage shelving module 10 but more than two different types of telescoping elements 18 may be used if desired, such as for appearance. As shown in the preferred embodiment, the telescoping elements 18 of the base frame sub-assembly 24 (see FIGS. 4 and 5) each have one horizontal outer leg 20, one horizontal inner leg 22 and one vertical outer leg 20, whereby each horizontal inner leg 22 of the four telescoping elements 18 telescopes within a horizontal outer leg 20 of the adjacent telescoping element 18. Thus, when the four telescoping elements shown in FIG. 4 are moved in the directions of the arrows shown therein, they are brought into a telescopic relationship forming the lower frame sub-assembly shown in FIG. 5. Similarly, each telescoping element 18 of the upper frame sub-assembly 26 has one horizontal outer leg 20 and one horizontal inner leg 22 for telescopic assembly of the four elements 18 but the vertical leg of each telescoping element 18 of the upper frame sub-assembly 26 is an inner leg 22 for telescopically fitting into the vertical outer leg 20 of each of the telescopic elements of the base frame 24 (see FIGS. 3, 9 and 10). When the size of the objects to be displayed or stored do not require one or more shelves between the base frame 24 and upper frame 26, those two frames can be assembled to a simple cube, as shown in FIG. 2. Since all eight leg assemblies of the storage module frame 12 are formed of telescoping members and define telescopic relationships (an inner leg 22 within an outer leg 20), the storage module frame 12 may be expanded in heighth, width or depth to almost twice the size in each direction from the closed condition shown in FIG. 2.

If expansion were only desired in two dimensions, e.g., width and depth, only the horizontally extending legs would need to define telescopic relationships and the vertical legs could be of a fixed length. Similarly, if only vertical expansion capability were desired, only the vertically extending legs would have to define telescoping relationships. Single dimension expansion can be conveniently obtained by providing telescopic relationships in only the direction of desired expansion. In the preferred embodiment discussed above, expansion in all three dimensions is provided for maximum flexibility. The manner in which the telescoping legs 20 and 22 may be joined together will be described below.

Figure 1:
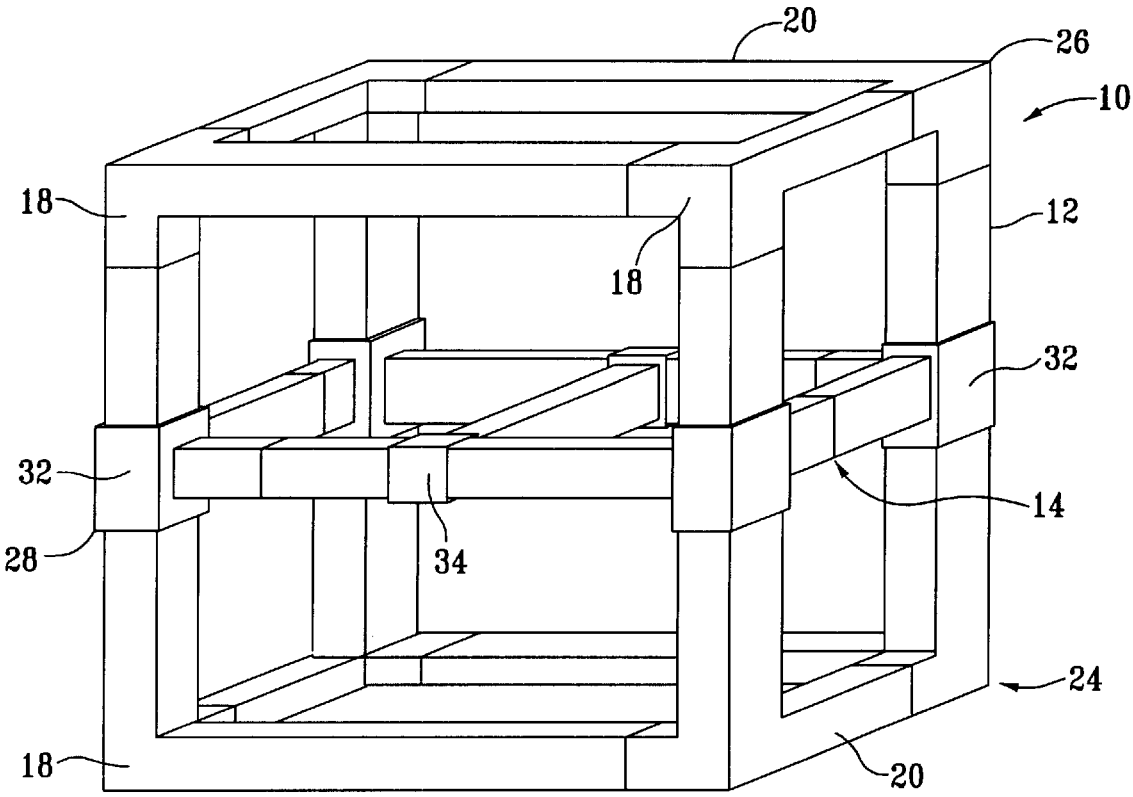
FIG. 1 is a perspective view of the storage module of this invention without the shelving installed.
Figure 6:
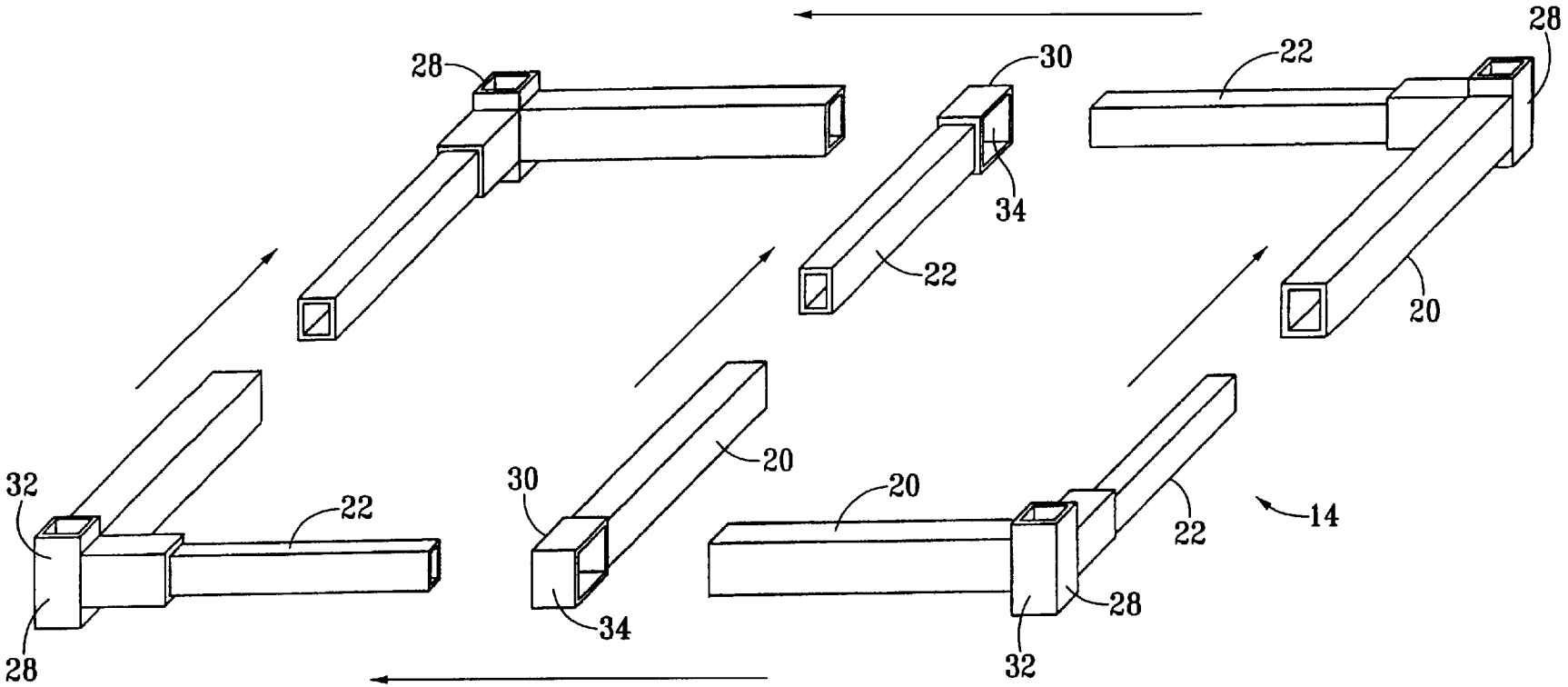
FIG. 6 is an exploded perspective view of the telescoping elements for the shelf support assembly shown in FIG. 1.
Figure 7:
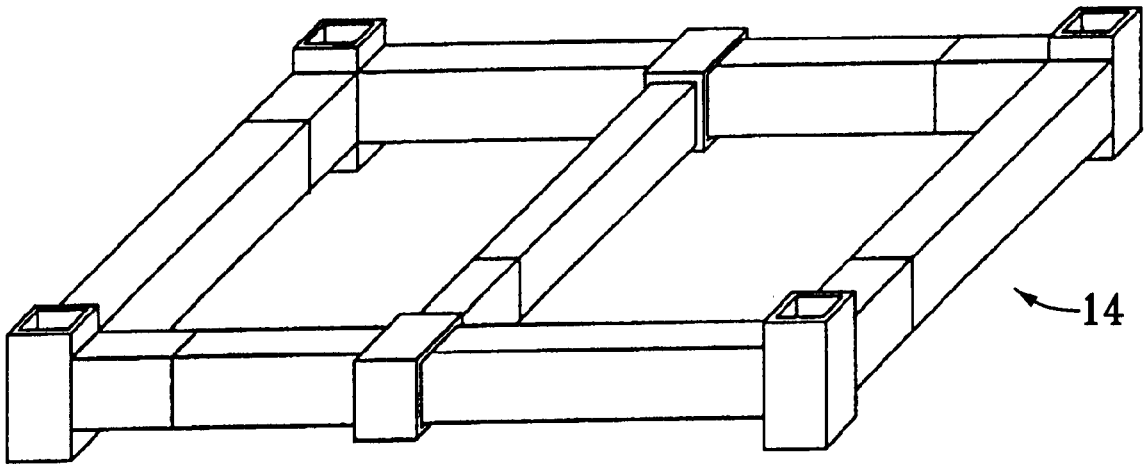
FIG. 7 is a perspective view of the assembled telescoping elements shown in FIG. 6 forming the shelf support assembly.
Figure 8:
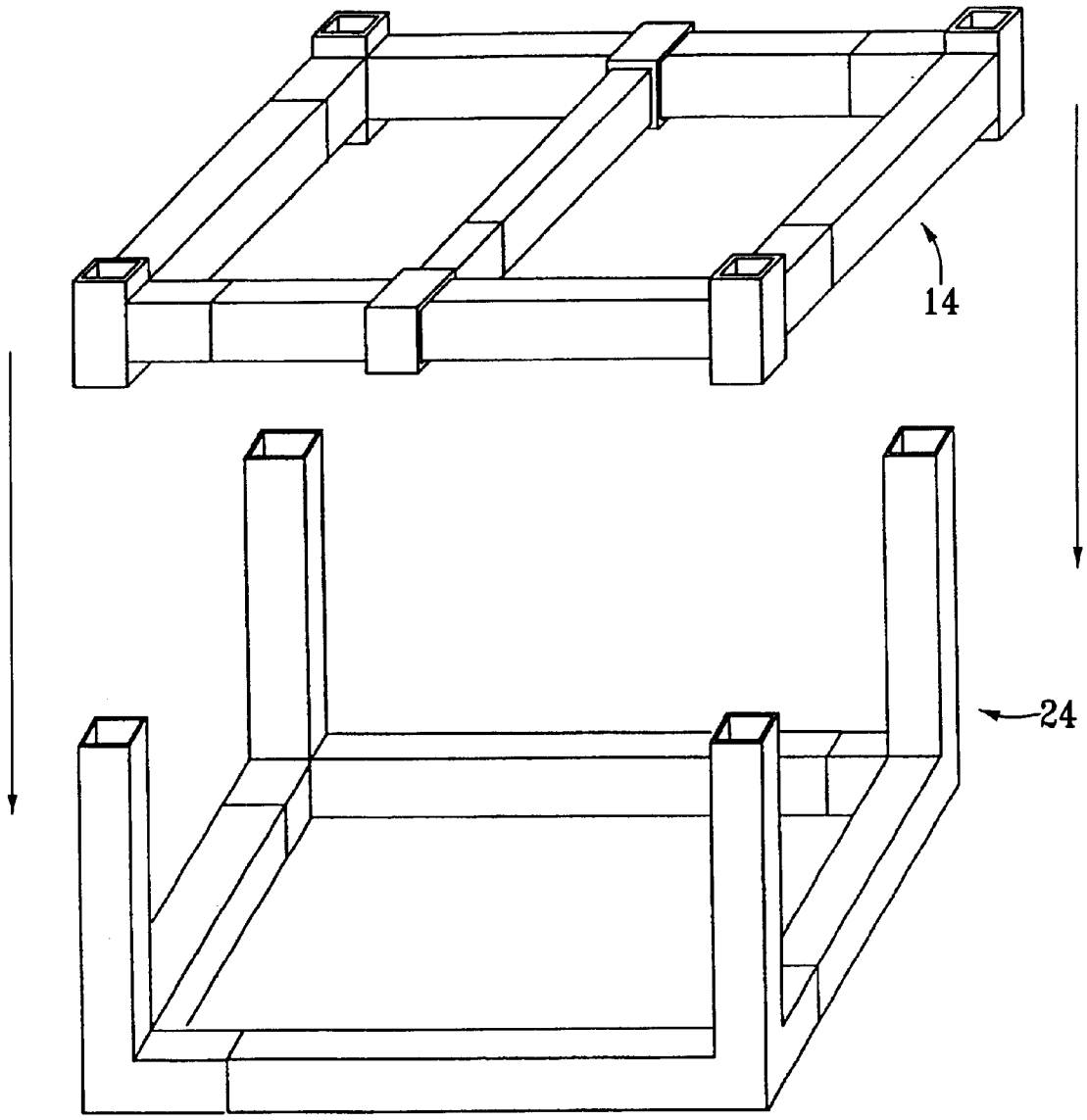
FIG. 8 is an exploded perspective view of the base frame sub-assembly shown in FIG. 5 and the shelf support assembly shown in FIG. 7 being assembled together.
Figure 10:
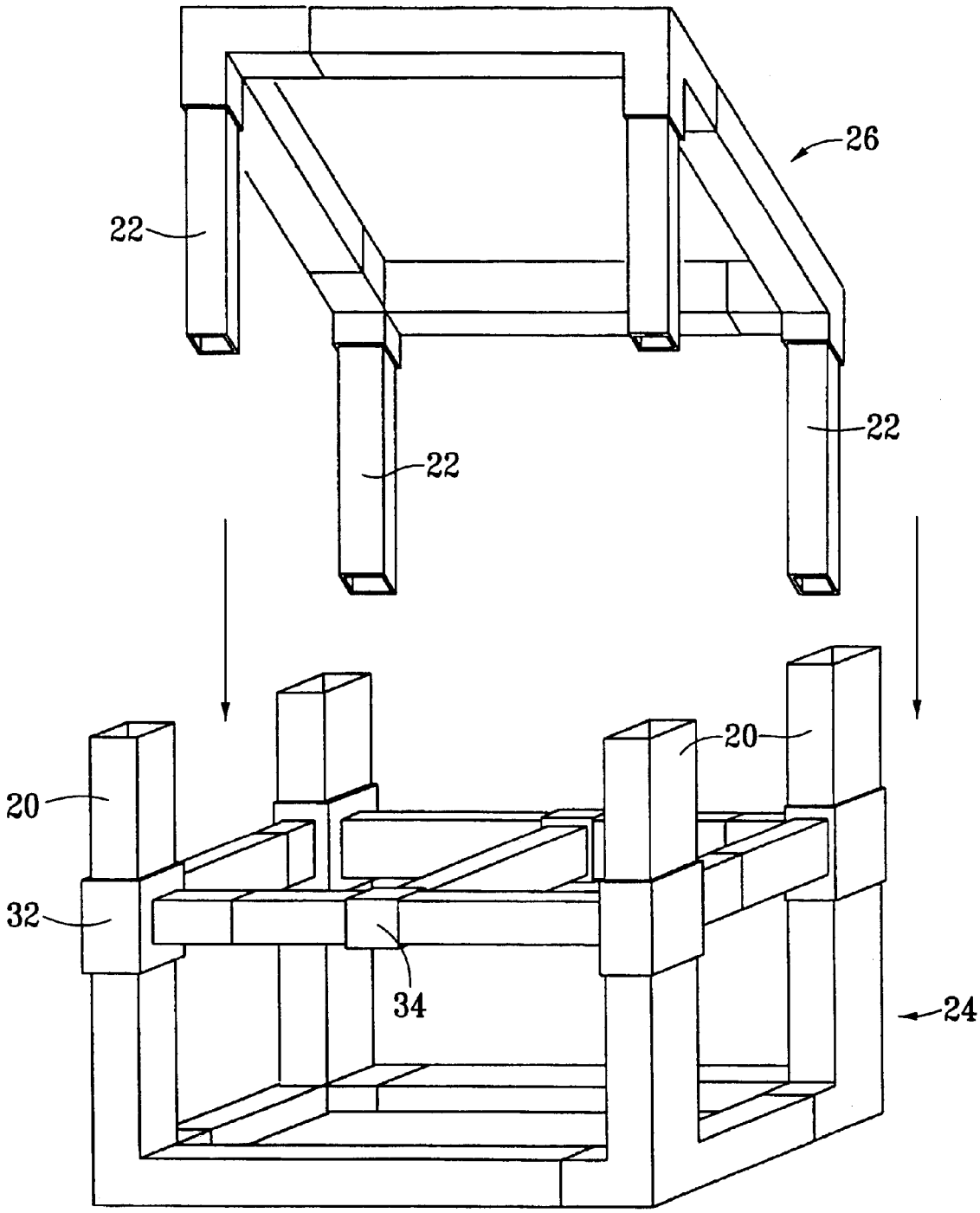
FIG. 10 is an exploded perspective view of the assembly of the upper frame sub-assembly shown in FIG. 9 to the assembled base frame sub-assembly and shelf support assembly shown in FIG. 8.
Figure 11:
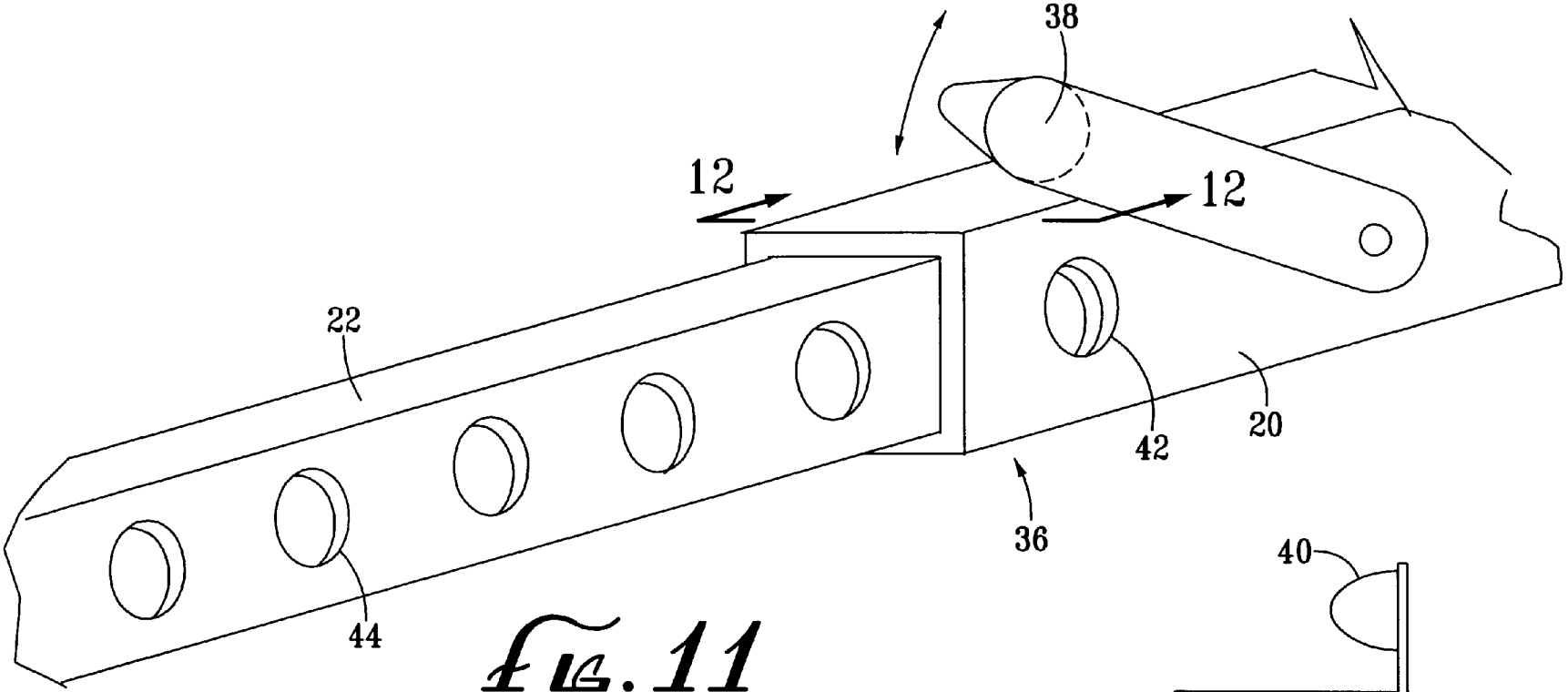
FIG. 11 is a perspective view of one embodiment of an adjustment lock mechanism for interlocking the telescoping elements of the storage module frame.
Figure 12:
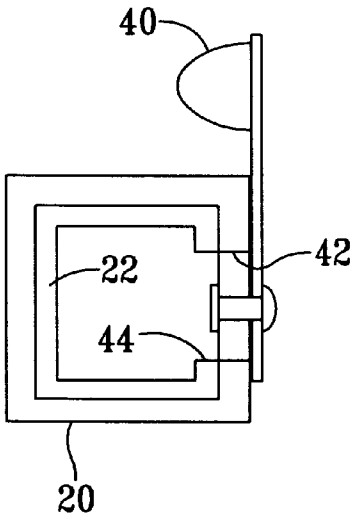
FIG. 12 is a sectional view taken on the line 12—12 of FIG. 11 and illustrating the adjustment lock mechanism in an unlocked condition.

When one or more intermediate shelves are required in the storage module frame 12, a shelf support assembly 14 and sliding shelf 16 may be installed on the storage module frame 12. The shelf support assembly 14 is preferably formed of four corner elements 28 and two cross members 30. Each corner element 28 includes a horizontal outer leg 20 and a horizontal inner leg 22 whereby the inner leg 22 of each corner element 28 is telescopically received within the outer leg 20 of the adjacent corner element 28 in the same manner that the telescopic elements 18 of the storage module frame 12 are assembled. Further, each corner element 28 includes a tubular corner 32 defining a vertically extending open ended channel 32'therein adapted to slide over the vertical outer leg 20 of the base frame telescopic element 18, as shown in FIG. 1. In the event the storage module frame 12 is extended to a substantial heighth and additional shelving is required, the tubular corner 32 of each corner element 28 may be of a smaller internal size for slidably fitting onto an inner leg 22 of the upper frame 26. Each cross member 30 has a tubular end 34 defining a horizontally extending open ended channel 34' therein for receiving an outer leg 20 of a corner element 28. One cross member 30 defines an inner leg 22 for defining a telescopic relationship with an outer leg 20 on the other cross member 30, as shown in FIG. 6. Thus, the shelf support assembly 14 is adjustable in both horizontal directions for accommodating the size adjustments of the storage module frame 12. The shelf support assembly 14 is preferably installed on the base frame 24, as shown in FIG. 8, before the upper frame 26 is installed on the base frame 24, as shown in FIG. 10. Again, if expansion were desired in only a single direction, e.g. width, only the legs extending in the direction of the desired expandability would need to be disposed in a telescopic relationship.

Figure 13:
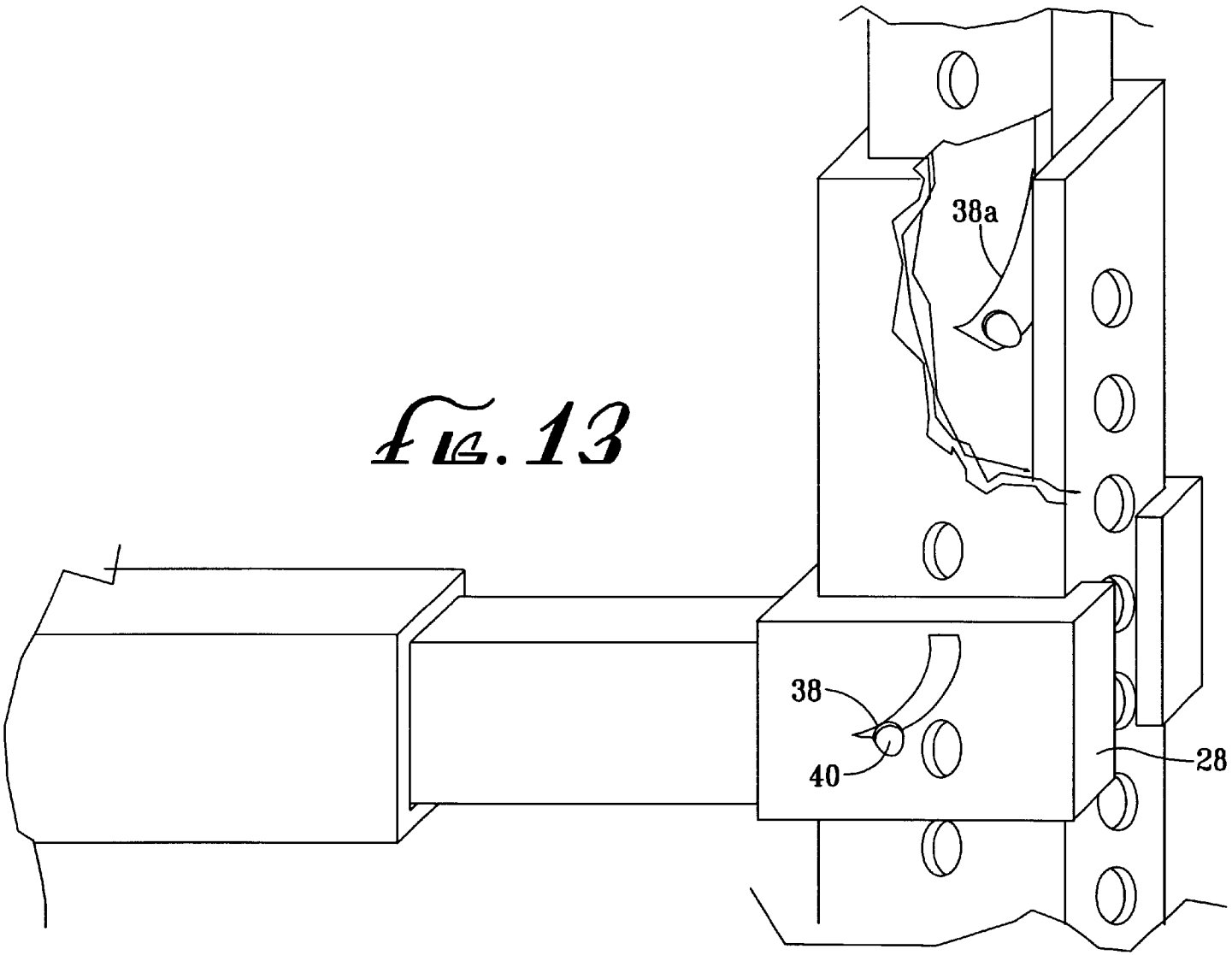
FIG. 13 is a perspective view with cut-away portions of the adjustment lock mechanism of FIGS. 11 and 12 at different locations on the storage module of FIG. 1.
Figure 14:
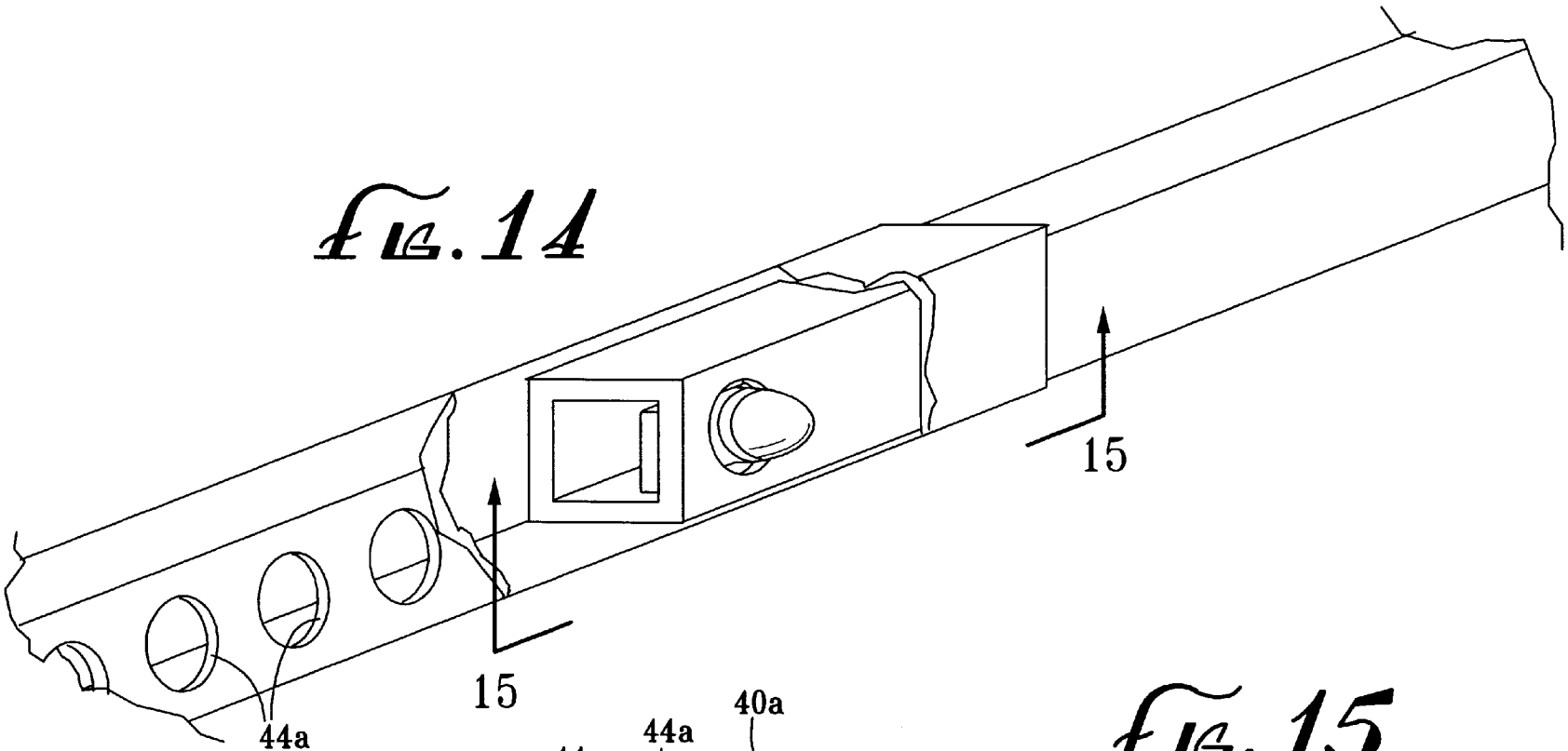
FIG. 14 is a fragmentary perspective view of a second storage lock mechanism for locking the telescoping elements of the storage module frame.
Figure 15:
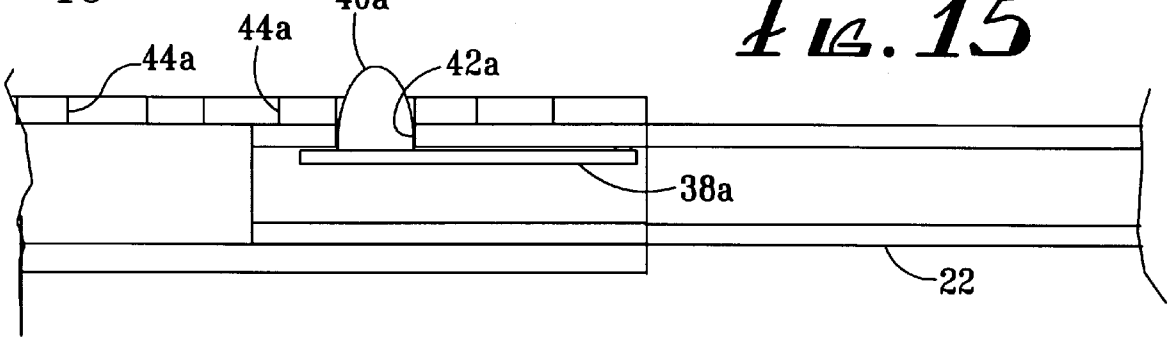
FIG. 15 is a sectional view taken substantially on the line 15—15 in FIG. 14 and illustrating the second embodiment of the adjustment lock mechanism in the locked condition.

The telescoping inner legs 22 and outer legs 20 may be locked in any desired position to adjust the size of the storage shelving module 10 by any convenient means, such as the two embodiments shown in FIGS. 11–15, or by any other convenient means. The adjustment lock mechanism 36 of the first embodiment shown in FIGS. 11–13 includes a spring arm 38 either pivotally or fixedly mounted to a location near the end of an outer leg 20 of a telescoping element 18 and has a bull nose pin 40 on the extending end to selectively protrude into a hole 42 provided on outer leg 20. The inner leg 22 is provided with a plurality of longitudinally spaced holes 44 opposite hole 42 whereby the pin 40 can releasably connect the inner leg 22 to the outer leg 20 by engaging both holes 42 and 44. This same arrangement also can be used on the corner elements 28, as shown in FIG. 13. Similarly, a spring arm 38*a* may be attached to the inside of an inner leg 22 for a bull nose pin 40*a* to pass through a hole 42*a* in the inner leg 22 and engage a selected hole 44*a* in the outer leg 20, as shown in FIGS. 14 and 15 that illustrate the second embodiment of the lock mechanism. Additional embodiments of locking mechanisms could also be employed in the present invention, including, for example, the use of a plurality of separate removable locking pins in the longitudinally spaced aperture configuration illustrated in FIG. 11 wherein a removable locking pin could project through the aperture 42 in the outer leg 20 and a selected one of the longitudinally spaced apertures 44 in the inner leg to secure the two legs in the desired fixed disposition.

Figure 16:
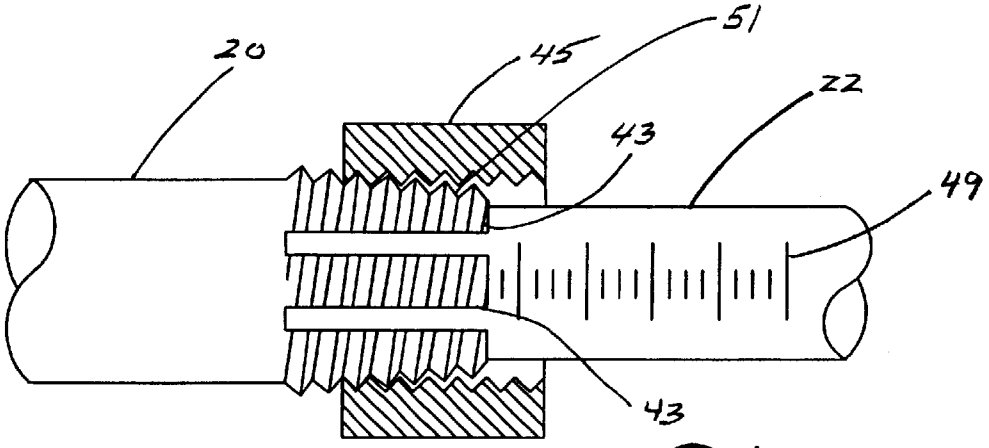
FIG. 16 is a partial cross sectional view of a third embodiment of a storage lock mechanism for locking the telescoping elements of the storage module frame.
Figure 17:
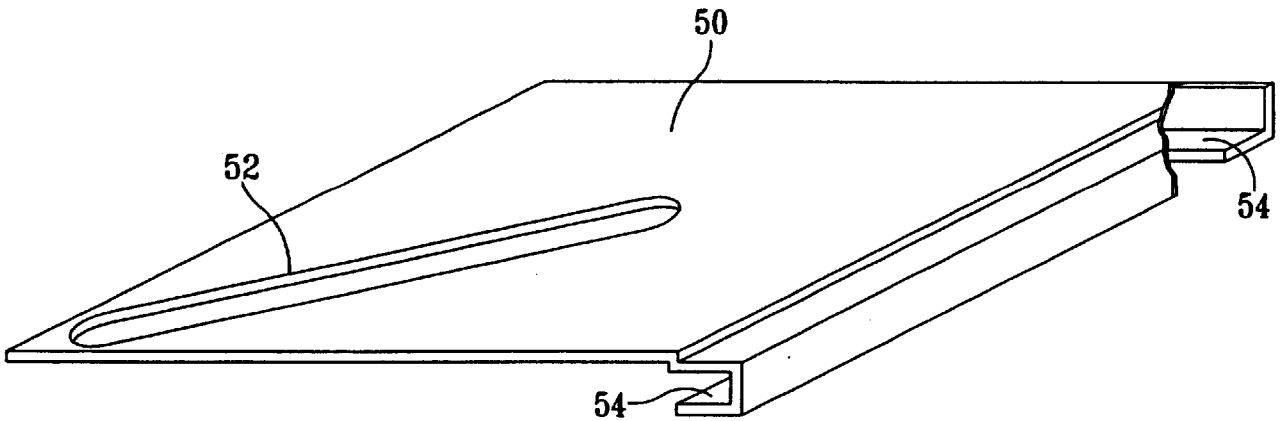
FIG. 17 is a perspective view of a sliding shelf element for use with the storage module illustrated in FIG. 1.

Another embodiment of a locking mechanism is illustrated in FIG. 16 wherein the pairs of the telescoping legs are continuously adjustable. As seen therein, the outer and inner legs 20 and 22 are of a generally cylindrical construction and an end portion of the outer leg 20 is slotted so as to define axially gripping arms 43 which extend about the inner leg 22. A clamping ring 45 of a conventional configuration is disposed about the gripping arms 43 for tightening the gripping arms 43 against the inner leg 22 to secure the two legs in place. Markings 49 are preferably provided on the inner leg 22 to facilitate uniform adjustments to the various pairs of legs 20 and 22 disposed in telescopic relationships. In the continuously adjustable configuration illustrated in FIG. 16, the gripping arms define tapered outer threads 51 which are threadably engaged by clamping member 45 to lock the outer and inner legs 20 and 22 in a fixed disposition. Other known clamping mechanisms could, of course, also be employed to lock legs 20 and 22 in a desired collective length.

Figure 20:
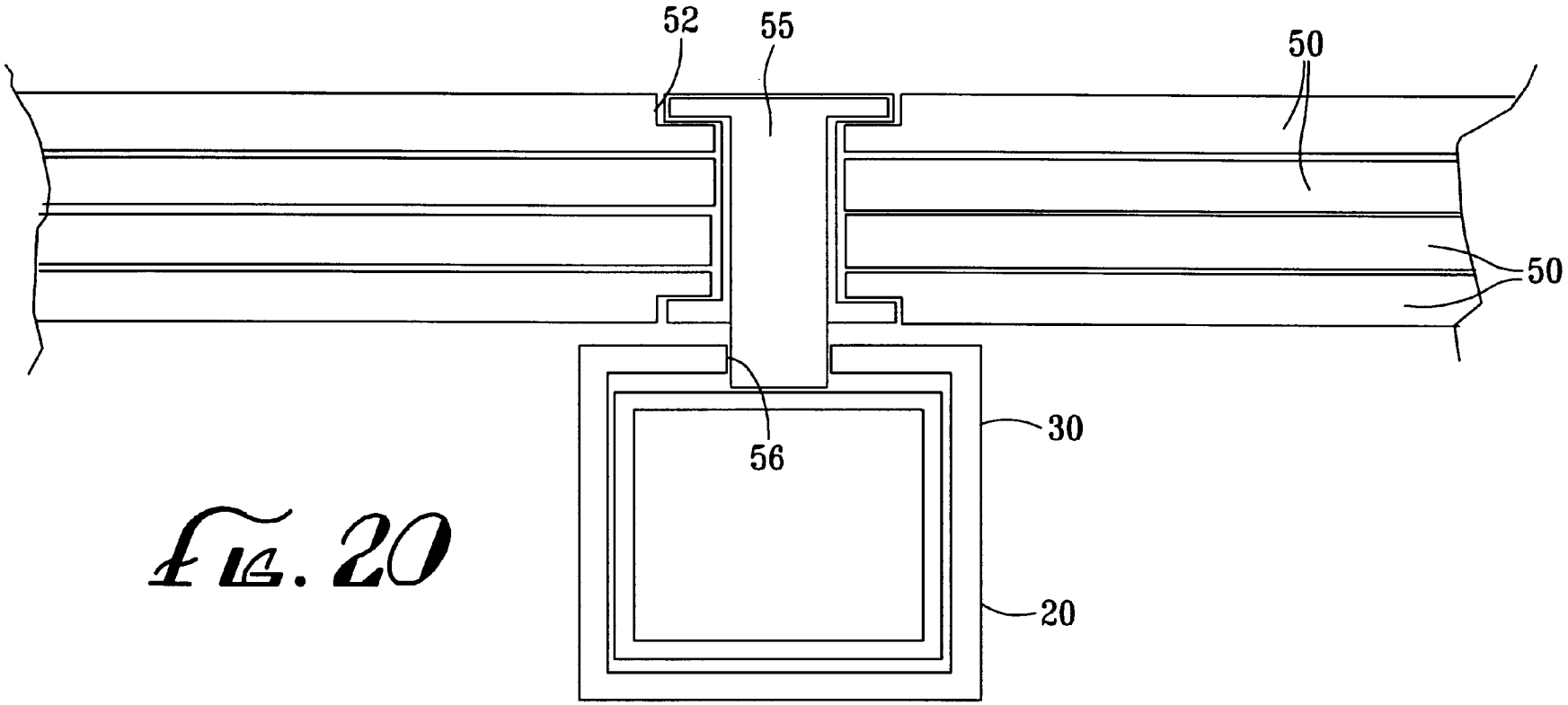
FIG. 20 is a sectional elevation view illustrating the index pin and cross members of the shelf support assembly for connecting the four sliding shelf elements illustrated in FIGS. 18 and 19.

Shelving for resting on the horizontal legs of the base frame 24, shelf support assembly 14 or horizontal legs of upper frame 26 also is preferably adjustable in size, such as a sliding shelf assembly 16 although boards or sheets of various sizes may be used with the adjustable storage module frame 12. Referring now to FIGS. 17–20, the sliding shelf assembly 16 is comprised of four shelf elements 50 having a substantially square upper surface. Each sliding shelf element 50 includes a guide flange 54 on each of two adjacent sides for interengaging one of the other shelf elements 50 to allow sliding movement between the closed position shown in FIG. 18 to the extended position shown in FIG. 19. In the embodiment of the shelf assembly 16 shown in the drawings, each shelf element has a diagonal slot 52 therein and an index pin 55 extends through each of the overlapping slots 52 in the four shelf elements 50 and engages a hole 56 in the outer leg 20 of the cross member 30 of the shelf support assembly 14, as shown in FIG. 20. Similarly, cross members 30 may be provided on the base frame 24 and the upper frame 26 for supporting a sliding shelf assembly 16 and an index pin 55 may be provided thereon for engaging such cross members 30. In the event the shelf elements 50 were slidably moved to a rectangular configuration (not shown), the diagonal slot 52 on one of the shelf elements would no longer intersect all of the slots 52 in the other shelf elements. In a rectangular configuration, each slot 52 in each shelf element would only intersect one other slot in another shelf element, thus defining two separate locations where the slots 52 overlap or intersect. Two separate indexing pins could then be inserted through each of the two points where the slots intersect to secure the shelf elements in the desired rectangular configuration. Because the shelving in the present invention merely rests on the shelf support assembly 14 and the shelf support assembly 14 is secured in a fixed disposition within the storage module 10 by the lock mechanisms 36, it may not prove necessary to separately secure the shelf assembly 16 in place. Accordingly, slots 52 and indexing pins 55 may not be necessary in many applications.

The storage shelving module 10 may be provided with casters (not shown) on the corners of the four telescoping elements 18 of the base frame 24 for allowing the storage shelving module to be moved readily, which does not change or adversely affect the ability to expand and contract the size of the module. Further, the storage module frame 12 may be provided with means for stacking another storage module frame 12 on top, such as holes and dowel pins in the upper surfaces of the telescoping elements 18 of the upper frame 26, or brackets to connect adjacent telescoping elements 18.

The aforedescribed storage shelving module 10 may be of any size and essentially can expand its volume by the cube of the length of the legs 20, 22, if those legs are of the same length. For example, if the storage module is two feet high, two feet wide, and two feet deep in its closed or most compact condition, as shown in FIGS. 1 and 2, the cubic volume of the storage module 12 is eight cubic feet. If the storage shelving module 10 is expanded to its maximum heighth, width and depth, each of which will be approximately four feet, the cubic volume of the storage shelving module 10 will be approximately 64 cubic feet. Of course, the actual volume in the expanded condition will be slightly less since each telescopic leg cannot extend to a length that is fully twice the starting length.

Various changes and modifications may be made in carrying out the present invention without departing from the spirit and scope thereof. Insofar as such changes and modifications are within the purview of the appended claims, they are to be considered as part of the present invention.

We claim:

1. A storage shelving module expandable in three dimensions so as to vary the size and capacity of the module without the need to supplement or replace the components thereof, said module comprising first and second frame sub-assemblies, each sub-assembly including four telescoping elements, each of said elements defining a pair of horizontally extending legs and a vertically extending leg, each horizontally extending leg defined by a telescoping element in said first sub-assembly being disposed in a telescopic relationship with another horizontally extending leg in said first sub-assembly, each horizontally extending leg defined by a telescoping element in said second sub-assembly being disposed in a telescopic relationship with another horizontally extending leg in said second sub-assembly, and each vertically extending leg defined by a telescoping element in said first sub-assembly being disposed in a telescopic relationship with a vertically extending leg defined by a telescoping element in said second sub-assembly, and a plurality of leg locking mechanisms, one of said mechanisms being operatively connected to each pair of legs disposed in a telescopic relationship for securing said pair of legs together in a fixed disposition at selective locations whereby the collective length of each of said pairs of legs is adjustable to vary the size and capacity of said shelving module.

2. The storage shelf module of claim 1 wherein said legs defined by said telescoping elements comprise inner legs and outer legs, said telescopic relationship being defined by at least a portion of an inner leg of one of said elements being slidably disposed within an outer leg of another of said elements, each of said telescoping elements defining a horizontally extending outer leg and a horizontally extending inner leg, said elements in one of said frame sub-assemblies defining vertically extending outer legs and the elements in the other of said sub-assemblies defining vertically extending inner legs.

3. A storage shelving module expandable in three dimensions so as to vary the size and capacity of the module without the need to supplement or replace the components thereof, said module comprising first and second frame sub-assemblies, each sub-assembly including four telescoping elements, each of said elements defining a horizontally extending outer leg and a horizontally extending inner leg, each of the elements in one of said sub-assemblies additionally defining a vertically extending outer leg and each of the elements in the other of said sub-assemblies additionally defining a vertically extending inner leg, each horizontally extending inner leg defined by a telescoping element in said first sub-assembly being disposed in a telescopic relationship with a horizontally extending outer leg of another telescoping element in first sub-assembly, each horizontally extending inner leg defined by a telescoping element in said second sub-assembly being disposed in a telescopic relationship with a horizontally extending outer leg of another telescoping element in said second sub-assembly, and each vertically extending outer leg defined by a telescoping element in one of said sub-assemblies being disposed in a telescopic relationship with a vertically extending leg defined by a telescoping element in the other of said sub-assemblies, and a plurality of locking mechanisms, one of said mechanisms being operatively connected to each pair of legs disposed in a telescopic relationship for securing said pair of legs together in a fixed disposition at selective locations, said leg locking mechanisms comprising a plurality of longitudinally spaced apertures disposed in said inner legs, an aperture disposed in said outer legs and a plurality of spring biased locking pins carried by said outer legs, each of said pins being adapted to project through the aperture in one of said outer legs and a selected one of said apertures in said inner leg whereby the collective lengths of said inner and outer legs in said telescopic relationships can be varied to vary the size and capacity of said shelving module.

4. A storage shelving module expandable in three dimensions so as to vary the size and capacity of the module without the need to supplement or replace the components thereof, said module comprising first and second frame sub-assemblies, each sub-assembly including four telescoping elements, each of said elements defining a horizontally extending outer leg and a horizontally extending inner leg, each of the elements in one of said sub-assemblies additionally defining a vertically extending outer leg and each of the elements in the other of said sub-assemblies additionally defining a vertically extending inner leg, each horizontally extending inner leg defined by a telescoping element in said first sub-assembly being disposed in a telescopic relationship with a horizontally extending outer leg of another telescoping element in first sub-assembly, each horizontally extending inner leg defined by a telescoping element in said second sub-assembly being disposed in a telescopic relationship with a horizontally extending outer leg of another telescoping element in said second sub-assembly, and each vertically extending outer leg defined by a telescoping element in one of said subassemblies being disposed in a telescopic relationship with a vertically extending leg defined by a telescoping element in the other of said sub-assemblies, and a plurality of locking mechanisms, one of said mechanisms being operatively connected to each pair of legs disposed in a telescopic relationship for securing said pair of legs together in a fixed disposition at selective locations, said locking mechanisms comprising a plurality of longitudinally spaced apertures disposed in one of said outer legs, a plurality of spring biased locking pins carried by said inner legs, each of said pins being adapted to project through a selected one of said apertures in an outer leg whereby the collective lengths of said inner and outer legs in said telescopic relationships can be varied to vary the size and capacity of said shelving module.

5. A storage shelving module expandable in three dimensions so as to vary the size and capacity of the module without the need to supplement or replace the components thereof, said module comprising first and second frame sub-assemblies, each sub-assembly including four telescoping elements, each of said elements defining a pair of horizontally extending legs and a vertically extending leg, each horizontally extending leg defined by a telescoping element in said first sub-assembly being disposed in a telescopic relationship with another horizontally extending leg in said first sub-assembly, each horizontally extending leg defined by a telescoping element in said second sub-assembly being disposed in a telescopic relationship with another horizontally extending leg in said second sub-assembly, and each vertically extending leg defined by a telescoping element in said first sub-assembly being disposed in a telescopic relationship with a vertically extending leg defined by a telescoping element in said second sub-assembly, a plurality of leg locking mechanisms, one of said mechanisms-being operatively connected to each pair of legs disposed in a telescopic relationship for securing said pair of legs together in a fixed disposition at selective locations whereby the collective length of each-of said pairs of legs is adjustable to vary the size and capacity of said shelving module, and a shelf support assembly comprising four telescoping corner elements and a pair of cross members, each of said corner elements defining a pair of horizontally extending legs and a vertically extending open ended channel, said cross members being axially aligned and extending horizontally across said shelf support assembly in a telescopic relationship, each cross member defining a horizontally extending open ended channel therein adjacent an extended end thereof, each said horizontally extending leg defined by one said corner elements being disposed in a telescopic relationship with a horizontally extending leg defined by another of said corner elements, at least one of said horizontally extending legs defined by one said corner elements extending through one of said horizontally extending channels in one of said cross members, and at least one of said vertically extending legs defined by one of said telescoping elements extending through one of said vertically extending channels defined by one of said corner elements whereby said storage shelf support assembly is expandable in width and depth to accommodate variations in dimension of said storage shelving module.

6. The combination of claim 5 including an expandable shelf assembly adapted to be supported by said module, said shelf assembly comprising four substantially planar shelf elements, each of said shelf elements defining a substantially square upper surface and having a diagonally extending slot disposed therein and a pair of guide flanges extending downwardly and inwardly from adjacent perimeter portions of said surface, said shelf elements being slidably disposed in a stacked configuration such that each of said flanges on said shelf elements overlaps at least a portion of one of said flanges on another of said shelf elements such that each of said shelf elements is disposed in a telescopic relationship with each of said other shelf elements, and wherein the slot in each of said shelf elements extends across at least one slot in another of said shelf elements so as to define at least one slot intersection point, and including at least one locking pin adapted to extend through said slots at each such slot intersection point for securing said shelf elements in a fixed disposition whereby said shelf assembly is expandable to accommodate dimensional variations in said shelf support assembly.

7. The combination of claim 5 including an expandable shelf assembly adapted to be supported by said module, said shelf assembly comprising four substantially planar shelf elements, each of said shelf elements defining a substantially square upper surface and a pair of guide flanges extending downwardly and inwardly from adjacent perimeter portions of said surface, said shelf elements being slidably disposed in a stacked configuration such that each of said flanges on said shelf elements overlaps at least a portion of one of said flanges on another of said shelf elements such that each of said shelf elements is disposed in a telescopic relationship with each of said other shelf elements whereby said shelf assembly is expandable to accommodate dimensional variations in said shelf support assembly.

8. A storage shelving module expandable in at least two dimensions so as to vary the size and capacity of the module without the need to supplement or replace the components thereof, said module comprising first and second frame sub-assemblies, each sub-assembly including four telescoping elements, each element defining a pair of horizontally extending legs, each horizontally extending leg defined by a telescoping element in said first sub-assembly being disposed in a telescopic relationship with another horizontally extending leg in said first sub-assembly, each horizontally extending leg defined by a telescoping element in said second sub-assembly being disposed in a telescopic relationship with another horizontally extending leg in said second sub-assembly, a plurality of vertically disposed legs extending between said first and second sub-assemblies, and a plurality of leg locking mechanisms, one of said mechanisms being operatively connected to each pair of legs disposed in a telescopic relationship for securing said pair of legs together in a fixed disposition at selective locations whereby the collective length of each of said pairs of legs is adjustable to vary the size and capacity of said shelving module.

9. The storage shelf module of claim 8 wherein said legs defined by said telescoping elements comprise inner legs and outer legs, said telescopic relationship being defined by at least a portion of an inner leg of one of said elements being slidably disposed within an outer leg of another of said elements, each of said telescoping elements defining a horizontally extending outer leg and a horizontally extending inner leg.

10. The storage shelf module of claim 9 wherein said telescopic elements in one of said frame sub-assemblies define vertically extending outer legs and the elements in the other of said sub-assemblies define vertically extending inner legs.

11. A storage shelving module expandable in at least two dimensions so as to vary the size and capacity of the module without the need to supplement or replace the components thereof, said module comprising first and second frame sub-assemblies, each sub-assembly including four telescoping elements, each element defining a horizontally extending outer leg and a horizontally extending inner leg, each horizontally extending inner leg defined by a telescoping element in said first sub-assembly being disposed in a telescopic relationship with a horizontally extending outer leg of another telescoping element in said first sub-assembly, each horizontally extending inner leg defined by a telescoping element in said second sub-assembly being disposed in a telescopic relationship with a horizontally extending outer leg of another telescoping element in said second sub-assembly, a plurality of vertically disposed legs extending between said first and second sub-assemblies, and a plurality of leg locking mechanisms, one of said mechanisms being operatively connected to each pair of legs disposed in a telescopic relationship for securing said pair of legs together in a fixed disposition at selective locations, said leg-locking mechanisms comprising a plurality of longitudinally spaced apertures disposed in said inner legs, an aperture disposed in said outer legs and a plurality of spring biased locking pins carried by said outer legs, each of said pins being adapted to project through the aperture in one of said outer legs and a selected one of said apertures in an inner leg whereby the collective lengths of said inner and outer legs in said telescopic relationships can be varied to vary the size and capacity of said shelving module.

12. A storage shelving module expandable in at least two dimensions so as to vary the size and capacity of the module without the need to supplement or replace the components thereof, said module comprising first and second frame sub-assemblies, each sub-assembly including four telescoping elements, each element defining a horizontally extending outer leg and a horizontally extending inner leg, each horizontally extending inner leg defined by a telescoping element in said first sub-assembly being disposed in a telescopic relationship with a horizontally extending outer leg of another telescoping element in said first sub-assembly, each horizontally extending inner leg defined by a telescoping element in said second sub-assembly being disposed in a telescopic relationship with a horizontally extending outer leg of another telescoping element in said second sub-assembly, a plurality of vertically disposed legs extending between said first and second sub-assemblies, and a plurality of leg locking mechanisms, one of said mechanisms being operatively connected to each pair of legs disposed in a telescopic relationship for securing said pair of legs together in a fixed disposition at selective locations, said leg-locking mechanisms comprising a plurality of longitudinally spaced apertures disposed in one of said outer legs, a plurality of spring biased locking pins carried by said inner legs, each of said pins being adapted to project through a selected one of said apertures in an outer leg whereby the collective lengths of said inner and outer legs in said telescopic relationships can be varied to vary the size and capacity of said shelving module.

13. A storage shelving module expandable in at least two dimensions so as to vary the size and capacity of the module without the need to supplement or replace the components thereof, said module comprising first and second frame sub-assemblies, each sub-assembly including four telescoping elements, each element defining a pair of horizontally extending legs, each horizontally extending leg defined by a telescoping element in said first sub-assembly being disposed in a telescopic relationship with another horizontally extending leg in said first sub-assembly, each horizontally extending leg defined by a telescoping element in said second sub-assembly being disposed in a telescopic relationship with another horizontally extending leg in said second sub-assembly, a plurality of vertically disposed legs extending between said first and second sub-assemblies, and a plurality of leg locking mechanisms, one of said mechanisms being operatively connected to each pair of legs disposed in a telescopic relationship for securing said pair of legs together in a fixed disposition at selective locations whereby the collective length of each of said pairs of legs is adjustable to vary the size and capacity of said shelving module, and a shelf support assembly comprising four telescoping corner elements and a pair of cross members, each of said corner elements defining a pair of horizontally extending legs and a vertically extending open ended channel, said cross members being axially aligned and extending horizontally across said shelf support assembly in a telescopic relationship, each cross member defining a horizontally extending open ended channel therein adjacent an extended end thereof, each said horizontally extending leg defined by one said corner elements being disposed in a telescopic relationship with a horizontally extending leg defined by another of said corner elements, at least one of said horizontally extending legs defined by one said corner elements extending through one of said horizontally extending channels in one of said cross members, and at least one of said vertically extending legs defined by one of said telescoping elements extending through one of said vertically extending channels defined by one of said corner elements whereby said storage shelf support assembly is expandable in width and depth to accommodate variations in dimension of said storage shelving module.

14. The combination of claim 13 including an expandable shelf assembly adapted to be supported by said module, said shelf assembly comprising four shelf substantially planar elements, each of said shelf elements defining a substantially square upper surface and having a diagonally extending slot disposed therein and a pair of guide flanges extending downwardly and inwardly from adjacent perimeter portions of said surface, said shelf elements being slidably disposed in a stacked configuration such that each of said flanges on said shelf elements overlaps at least a portion of one of said flanges on another of said shelf elements such that each of said shelf elements is disposed in a telescopic relationship with each of said other shelf elements, and wherein the slot in each of said shelf elements extends across at least one slot in another of said shelf elements so as to define at least one slot intersection point, and including at least one locking pin adapted to extend through said slots at each such slot intersection point for securing said shelf elements in a fixed disposition whereby said shelf assembly is expandable to accommodate dimensional variations in said shelf support assembly.

15. The combination of claim 13 including an expandable shelf assembly adapted to be supported by said module, said shelf assembly comprising four substantially planar shelf elements, each of said shelf elements defining a substantially square upper surface and a pair of guide flanges extending downwardly and inwardly from adjacent perimeter portions of said surface, said shelf elements being slidably disposed in a stacked configuration such that each of said flanges on said shelf elements overlaps at least a portion of one of said flanges on another of said shelf elements such that each of said shelf elements is disposed in a telescopic relationship with each of said other shelf elements whereby said shelf assembly is expandable to accommodate dimensional variations in said shelf support assembly.

16. A storage shelving module expandable in at least one dimension so as to vary the size and capacity of the module without the need to supplement or replace the components thereof, said module comprising first and second frame sub-assemblies, each sub-assembly including four telescoping elements, each element defining a pair of horizontally extending legs, at least of one of said horizontally extending legs defined by a telescoping element in said first sub-assembly being disposed in a telescopic relationship with another horizontally extending leg in said first sub-assembly, at least one of said horizontally extending legs defined by a telescoping element in said second sub-assembly being disposed in a telescopic relationship with another horizontally extending leg in said second sub-assembly, a plurality of vertically disposed legs extending between said first and second sub-assemblies, and a plurality of leg locking mechanisms, one of said mechanisms being operatively connected to each pair of legs disposed in a telescopic relationship for securing said pair of legs together in a fixed disposition at selective locations whereby the length of each of said pairs of legs is adjustable to vary the size and capacity of said shelving module.

17. The storage shelf module of claim 16 wherein the legs defined by said telescoping elements and disposed in one of said telescopic relationships comprise inner and outer legs, said telescopic relationship being defined by at least a portion of an inner leg of one of said elements being slidably disposed within an outer leg of another of said elements.

18. A storage shelving module expandable in at least one dimension so as to vary the size and capacity of the module without the need to supplement or replace the components thereof, said module comprising first and second frame sub-assemblies, each sub-assembly including four telescoping elements, each element defining a pair of horizontally extending legs, at least of one of said horizontally extending legs defined by a telescoping element in said first sub-assembly being disposed in a telescopic relationship with another horizontally extending leg in said first sub-assembly, at least one of said horizontally extending legs defined by a telescoping element in said second sub-assembly being disposed in a telescopic relationship with another horizontally extending leg in said second sub-assembly, the legs defined by said telescoping elements and disposed in one of said telescopic relationships comprising inner and outer legs, said telescopic relationships being defined by at least a portion of an inner leg of one of said elements being slidably disposed within an outer leg of another of said elements, a plurality of vertically disposed legs extending between said first and second sub-assemblies, and a plurality of leg locking mechanisms, one of said mechanisms being operatively connected to each pair of legs disposed in a telescopic relationship for securing said pair of legs together in a fixed disposition at selective locations, said leg locking mechanisms comprising a plurality of longitudinally spaced apertures disposed in said inner legs, an aperture disposed in said outer legs, and a plurality of spring biased locking pins carried by said outer legs, each of said pins being adapted to project through the aperture in one of said outer legs and a selected one of said apertures in an inner leg whereby the collective lengths of said inner and outer legs in said telescopic relationships can be varied to vary the size and capacity of said shelving module.

19. A storage shelving module expandable in at least one dimension so as to vary the size and capacity of the module without the need to supplement or replace the components thereof, said module comprising first and second frame sub-assemblies, each sub-assembly including four telescoping elements, each element defining a pair of horizontally extending legs, at least of one of said horizontally extending legs defined by a telescoping element in said first sub-assembly being disposed in a telescopic relationship with another horizontally extending leg in said first sub-assembly, at least one of said horizontally extending legs defined by a telescoping element in said second sub-assembly being disposed in a telescopic relationship with another horizontally extending leg in said second sub-assembly, the legs defined by said telescoping elements and disposed in one of said telescopic relationships comprising inner and outer legs, said telescopic relationships being defined by at least a portion of an inner leg of one of said elements being slidably disposed within an outer leg of another of said elements, a plurality of vertically disposed legs extending between said first and second sub-assemblies, and a plurality of leg locking mechanisms, one of said mechanisms being operatively connected to each pair of legs disposed in a telescopic relationship for securing said pair of legs together in a fixed disposition at selective locations, said leg locking mechanisms comprising a plurality of longitudinally spaced apertures disposed in one of said outer legs, a plurality of spring biased locking pins carried by said inner legs, each of said pins being adapted to project through a selected one of said apertures in an outer leg whereby the collective lengths of said inner and outer legs in said telescopic relationships can be varied.

20. A storage shelving module expandable in at least two dimensions so as to vary the size and capacity of the module without the need to supplement or replace the components thereof, said module comprising first and second frame sub-assemblies, each sub-assembly including four telescoping elements, each element defining a pair of horizontally extending legs, each horizontally extending leg defined by a telescoping element in said first sub-assembly being disposed in a telescopic relationship with another horizontally extending leg in said first sub-assembly, each horizontally extending leg defined by a telescoping element in said second sub-assembly being disposed in a telescopic relationship with another horizontally extending leg in said second sub-assembly, a plurality of vertically disposed legs extending between said telescoping elements of said first and second sub-assemblies, and locking means for securing together in a fixed disposition each pair of legs disposed in a telescopic relationship such that the collective length of each of said pairs of legs is adjustable to vary the size and capacity of said shelving module.

21. The storage shelving module of claim 20 wherein each telescoping element in said first sub-assembly defines a vertically extending leg and each telescoping element of said second sub-assembly defines a vertically extending leg, and wherein each vertically extending leg defined by a telescoping element in said first assembly is disposed in a telescopic relationship with a vertically extending leg defined by a telescoping element in said second sub-assembly.

* * * * *